United States Patent [19]

Sakurai

[11] 4,187,677

[45] Feb. 12, 1980

[54] EXHAUST PORT LINER SUPPORT FOR INTERNAL COMBUSTION ENGINE

[75] Inventor: Yoshitoshi Sakurai, Niiza, Japan

[73] Assignee: Honda Giken Kogyo Kabushiki Kaisha, Tokyo, Japan

[21] Appl. No.: 894,588

[22] Filed: Apr. 7, 1978

Related U.S. Application Data

[63] Continuation of Ser. No. 677,665, Apr. 16, 1976, abandoned.

[51] Int. Cl.[2] ..... F01N 3/10

[52] U.S. Cl. ..... 60/282; 60/323; 123/193 H

[58] Field of Search ..... 60/272, 282, 323; 123/193 H

[56] References Cited

U.S. PATENT DOCUMENTS

| | | | |
|---|---|---|---|
| 2,257,631 | 9/1941 | Wahlberg | 60/323 |
| 2,260,656 | 10/1941 | Bell | 60/272 |
| 3,850,453 | 11/1974 | Bentley | 60/282 |
| 3,969,893 | 7/1976 | Sakurai | 60/282 |

FOREIGN PATENT DOCUMENTS

| | | | |
|---|---|---|---|
| 2323793 | 11/1974 | Fed. Rep. of Germany | 60/282 |

*Primary Examiner*—Douglas Hart

*Attorney, Agent, or Firm*—Lyon & Lyon

[57] ABSTRACT

A liner of thin wall heat resistant material is positioned to receive exhaust gases from two adjacent exhaust port passages of an internal combustion engine, downstream from the exhaust valves. Each liner has a single outlet opening formed within a circular projection. A support piece has a central opening which receives said projection, and the support piece has an outer peripheral skirt which is mounted in a recess at the outer end of a dual exhaust port passage. The support piece also serves to block flow of exhaust gases in the space between the liner and the enclosing exhaust port passages. In a modification, each liner receives exhaust gases from only one exhaust valve.

2 Claims, 3 Drawing Figures

EXHAUST PORT LINER SUPPORT FOR INTERNAL COMBUSTION ENGINE

This is a continuation of application Ser. No. 677,665, filed Apr. 16, 1976 now abandoned.

This invention relates to internal combustion engines and is particularly directed to improvements for supporting exhaust port liners. It has previously been proposed to employ exhaust port liners when it is desired to maintain the exhaust gases at a high temperature for a relatively long period of time, and when there is excess oxygen in the exhaust gases, for the purpose of reducing the amounts of unburned hydrocarbons and carbon monoxide in the gases discharged into the atmosphere.

Two methods of supporting the exhaust port liner are known; the first is to cast the liner in place directly in the cylinder head. This has a disadvantage, however, in that the contact area between the liner and the exhaust port wall is very large, so that the wall temperature of the liner drops with consequent lowering of the exhaust gas temperature, and this in turn causes a decrease in the reaction efficiency of HC and CO in the exhaust system.

The other known method of supporting the exhaust port liner is to provide the liner with a flange which extends between the cylinder head and another member, for example, an exhaust manifold member. This has the disadvantage, however, that because of pressure changes in the exhaust system, engine vibration, etc., the flange or its contacting surfaces wear away and the liner is left without a firm support.

The principal object of this invention is to provide an exhaust port liner support which is free of such disadvantages and which furthermore acts to block flow of exhaust gases in the space between the liner and the surrounding wall of the exhaust port passage in the engine head.

Other and more detailed objects and advantages will appear hereinafter.

Figure 1:
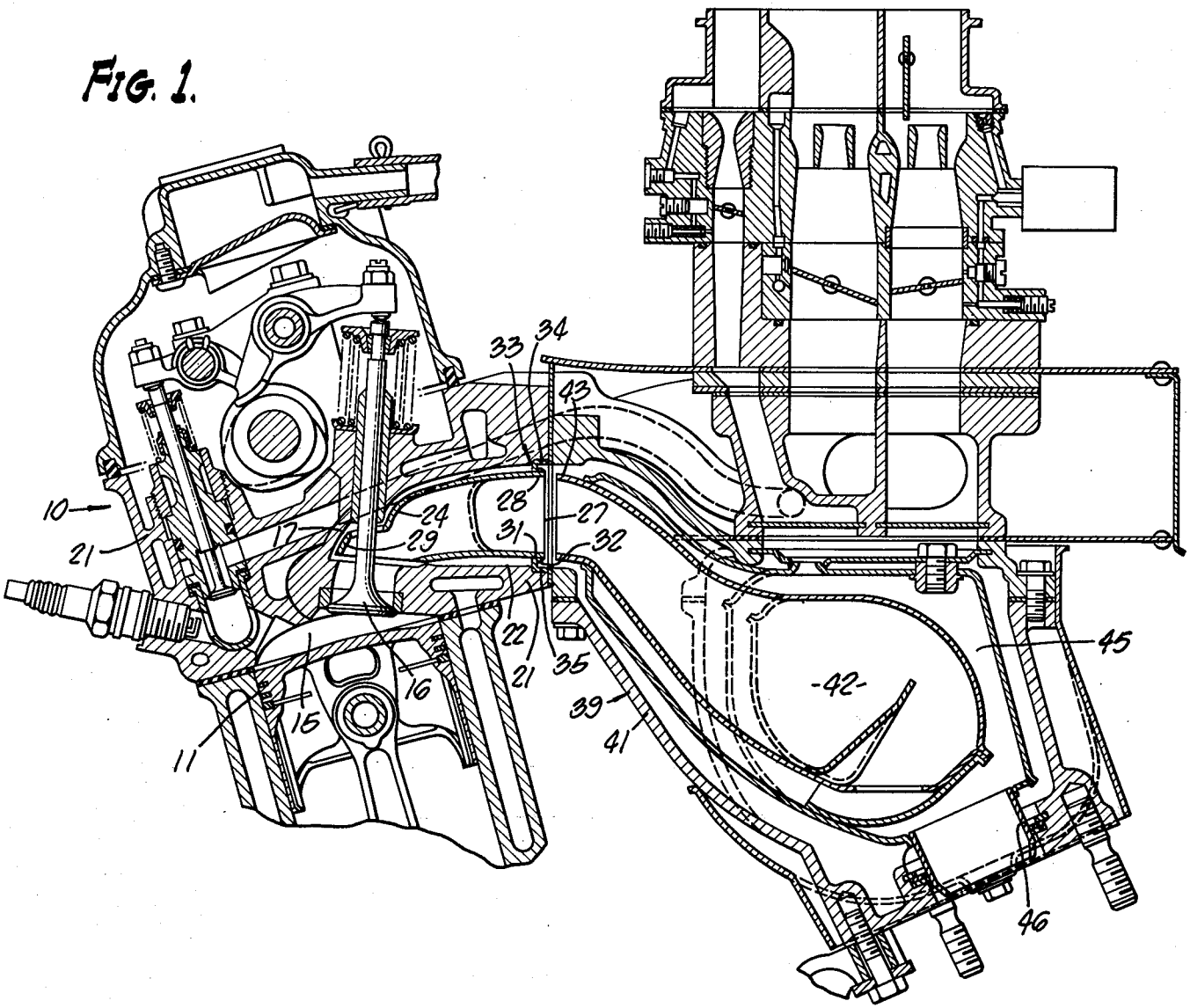
FIG. 1 is a sectional side elevation showing a preferred embodiment of this invention.
Figure 2:
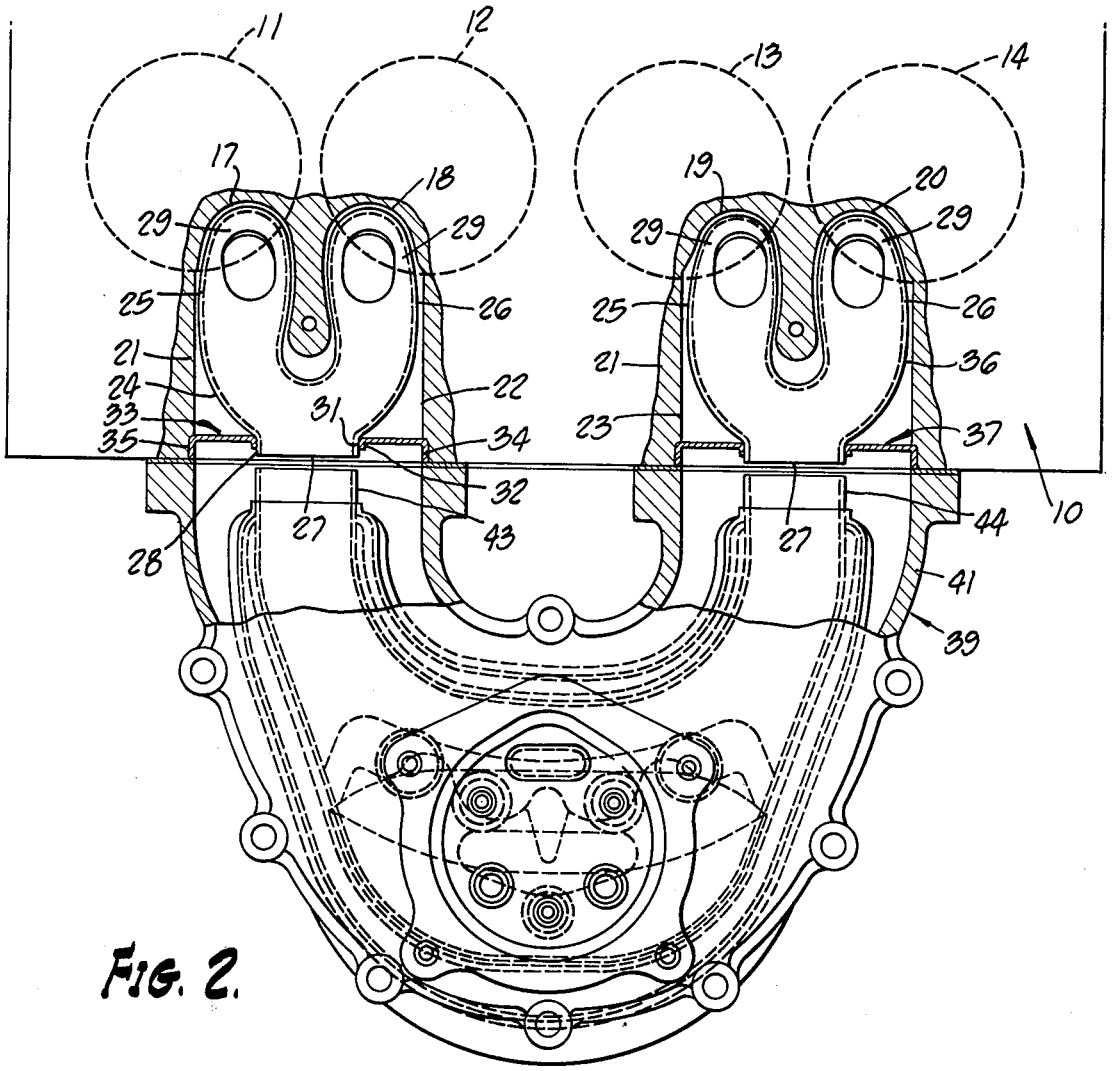
FIG. 2 is a sectional plan view.
Figure 3:
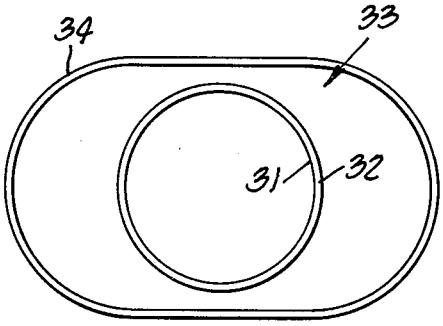
FIG. 3 is an end view showing one of the liner support pieces.

Referring to the drawings, an internal combustion engine generally designated 10 is provided with four cylinders 11, 12, 13 and 14, each having a main combustion chamber 15, and an exhaust valve 16. Exhaust port passages 17, 18, 19 and 20 are provided for the cylinders 11, 12, 13 and 14, respectively. Adjacent exhaust port passages 17 and 18 merge into a dual exhaust passage 22 and, similarly, adjacent exhaust port passages 19 and 20 merge into a dual exhaust passage 23 in the engine head 21.

In accordance with this invention, a dual exhaust port liner 24 of thin wall heat resistant material is inserted into position, in the absence of the valves 16, within adjacent exhaust port passages 17 and 18 and extends into the dual exhaust passage 22. The liner 24 is bifurcated so that it has two entrance portions 25 and 26 extending into the exhaust port passages 17 and 18, respectively, but the liner 24 has only a single discharge opening 27 formed within the circular projection 28.

The upstream bifurcated ends 29 of the liner 24 may be supported by the surrounding walls of the exhaust port passages 17 and 18, and the major portion of the length of the liner 24 is spaced from the enclosing walls of the engine head 21. The circular projection 28 at the downstream end of each liner 24 is welded into a central opening 31 provided in a flange 32 of a support piece 33, formed of imperforate plate. An outer peripheral skirt 34 on the support piece 33 is tightly fitted into a groove or recess 35 provided at the discharge end of the dual exhaust passage 22 and having a contour larger than the exhaust passage 22. The downstream end of the dual exhaust port liner 24 is thereby firmly fixed in position. The outer skirt 34 has a relatively small contact area with the engine head 21.

The support piece 33 serves the further function of blocking flow of exhaust gases around the outside of the liner 24 and within the exhaust port passages 17 and 18 and the dual exhaust passage 22. But the circular outer skirt 34 may be fitted into a circularly formed groove or recess only at the upper and lower portions of the exhaust passage to limit the contact area to a minimum.

The construction of the dual exhaust port liner 36 and its support piece 37 are substantially the same, respectively, as the liner 24 and its support piece 33.

This invention is similarly applicable to an exhaust port liner supported respectively by each exhaust port passage.

The exhaust manifold 39 includes an outer housing 41 having relatively thick walls, and within these walls are positioned an upstream reaction chamber 42 supplied through exhaust pipes 43 and 44 aligned respectively with the discharge openings 27 of the dual exhaust port liners 24 and 36. A downstream reaction chamber 45 surrounds and encircles the upstream reaction chamber 42 and each exhaust pipe 43 and 44. Exhaust gases are discharged from the downstream reaction chamber 45 through the discharge pipe 46. When the outer housing of the exhaust manifold 39 is put to the engine head 21, it holds the outer flanges 34 of the support pieces 33 and 37 in place.

In operation, exhaust gases from each of the combustion chambers 15 enter the exhaust port passages 17, 18, 19 and 20, in accordance with the firing sequence and operation of the exhaust valves 16. The exhaust gases pass into the bifurcated ends 29 of the entrance portions 25 and 26 of the dual exhaust port liners 24 and 36. The liners are held securely in position by means of the support pieces 33 and free from vibration, so that the liners can be assured of durability. The fact that the contact area between the outer skirt 34 and the engine head 21 is held to a minimum results in restraining excessive drop in temperature of the liner 22 and 36. Since the support pieces prevent flow of exhaust gases around the outside of the liners 24 and 36, cooling of the exhaust gases by contact with walls of the water-cooled engine head is largely prevented. Accordingly, the gases remain hot as they pass through the central discharge openings 27 into the exhaust pipes 43 and 44.

Having fully described my invention, it is to be understood that I am not to be limited to the details herein set forth but that my invention is of the full scope of the appended claims.

I claim:

1. In an internal combustion engine having an exhaust valve operatively interposed between walls forming a combustion chamber and wall forming an exhaust port passage, the improvement comprising, in combination: an exhaust port liner insertable into position within the exhaust port passage, in the absence of said valve, said liner being bifurcated to form two entrance portions, the major portion of the length of said liner being spaced with respect to the wall forming said exhaust port passage, said liner having a circular projection defining a discharge opening for said liner, and a support piece having a peripheral skirt tightly fitting into said wall of the exhaust port passage, said support piece being fixed on said liner projection, said support piece acting to prevent flow of exhaust gases between said liner and the wall of the exhaust port passage.

2. In a multi-cylinder internal combustion engine having exhaust ports grouped in pairs, each pair connected to a wall forming a single exhaust port passage, the improvement comprising, in combination: an exhaust port liner insertable into position within the exhaust port passage, each liner being shaped to provide entrance openings from two adjacent exhaust ports but having only a single discharge opening, the major portion of the length of said liner being spaced with respect to the wall forming said exhaust port passage, a recess provided at the discharge end of the exhaust port passage, and a support piece having a peripheral skirt, a central opening and an outer oval flange tightly fitted into said recess of the exhaust port passage, said support piece being fixed on said liner near its downstream end by said central opening.

* * * * *

UNITED STATES PATENT AND TRADEMARK OFFICE

CERTIFICATE OF CORRECTION

PATENT NO. : 4,187,677

DATED : February 12, 1980

INVENTOR(S) : Yoshitoshi Sakurai

It is certified that error appears in the above-identified patent and that said Letters Patent are hereby corrected as shown below:

On the first page should appear the following:

[30] Foreign Application Priority Data

April 22, 1975 Japan 50-54083

Signed and Sealed this

*Third* Day of *June 1980*

[SEAL]

*Attest:*

SIDNEY A. DIAMOND

*Attesting Officer*

*Commissioner of Patents and Trademarks*